US006926042B2

(12) United States Patent
Scheiwe

(10) Patent No.: US 6,926,042 B2
(45) Date of Patent: Aug. 9, 2005

(54) METHOD FOR MANUFACTURING A CROSSBEAM FOR A HEDDLE FRAME OF A LOOM AND CROSSBEAM OBTAINED BY SAID METHOD

(75) Inventor: Joseph Scheiwe, Habshelm (FR)

(73) Assignee: Stäubli Alsace, Faverges (FR)

( * ) Notice: Subject to any disclaimer, the term of this patent is extended or adjusted under 35 U.S.C. 154(b) by 162 days.

(21) Appl. No.: 10/349,996

(22) Filed: Jan. 24, 2003

(65) Prior Publication Data

US 2003/0140981 A1 Jul. 31, 2003

(30) Foreign Application Priority Data

Jan. 25, 2002 (FR) ..... 02 00961

(51) Int. Cl.[7] ..... D03C 9/06
(52) U.S. Cl. ..... 139/91
(58) Field of Search ..... 139/1 R, 91, 92; 403/363, 403; 156/60, 295, 297, 538, 556, 580

(56) References Cited

U.S. PATENT DOCUMENTS 3,754,577 A 8/1973 Heller
4,036,263 A * 7/1977 Kaufmann ..... 139/91
4,633,916 A 1/1987 Rast
4,706,717 A * 11/1987 Root et al. ..... 139/92
4,790,357 A 12/1988 Kramer
4,913,194 A 4/1990 Kramer
5,483,996 A * 1/1996 Mettler ..... 139/91

FOREIGN PATENT DOCUMENTS

EP 0302798 2/1989

* cited by examiner

*Primary Examiner*—John J. Calvert
*Assistant Examiner*—Shaun R Hurley
(74) *Attorney, Agent, or Firm*—Greenblum & Bernstein, P.L.C.

(57) ABSTRACT

The present invention relates to a method for manufacturing a crossbeam for a heddle frame of a loom allowing to make, at low cost and without waste, a lightweight and very rigid crossbeam, whose heddle-support rod is positioned on the support section in an accurate position that is completely linear, controlled and capable of being reproduced. This manufacturing method is characterized in that one uses a rigid template that has at least one rectilinear groove having a width substantially equal to that of the heddle-support rod; one positions the non-rigid heddle-support rod in the groove to make it rectilinear; one lays a glue line on the junction zone; one positions a rigid support section that is not necessarily rectilinear in a predetermined manner on the template and on the heddle-support rod by flattening the glue line, and one maintains the support section and the heddle-support rod integral with the template, at lease while the glue is setting.

27 Claims, 4 Drawing Sheets

FIG. 2A
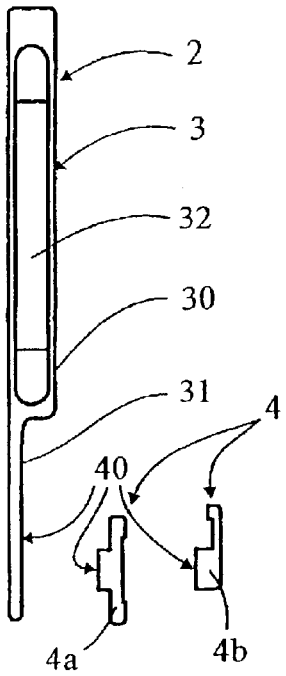
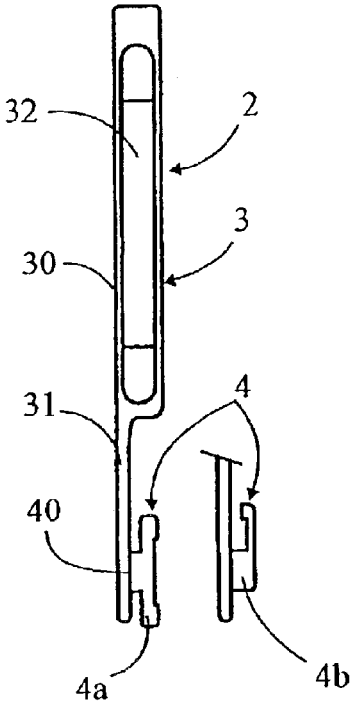
FIG. 2B
FIG. 5A
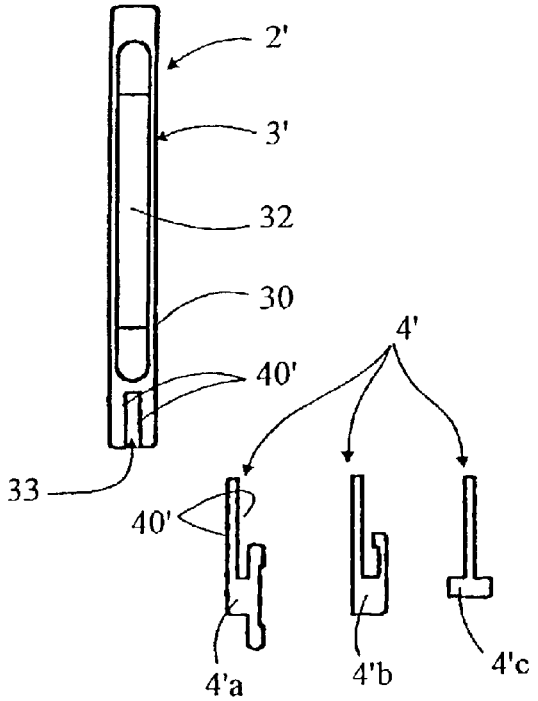
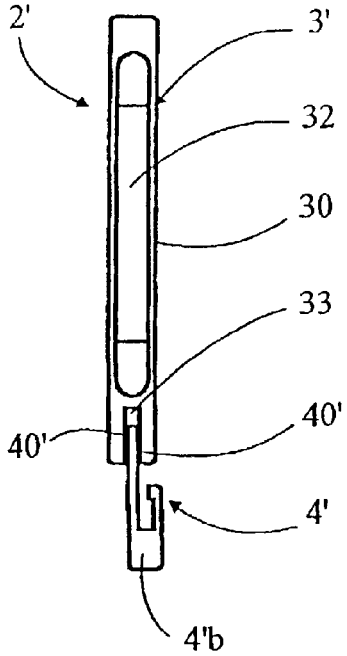
FIG. 5B

METHOD FOR MANUFACTURING A CROSSBEAM FOR A HEDDLE FRAME OF A LOOM AND CROSSBEAM OBTAINED BY SAID METHOD

CROSS-REFERENCE TO RELATED APPLICATIONS

The present application claims priority under 35 U.S.C. § 119 of French Patent Application No. 02.00961, filed on Jan. 25, 2002, the disclosure of which is expressly incorporated by reference herein in its entirety.

BACKGROUND OF THE INVENTION

1. Field of the Invention

The present invention relates to a method for manufacturing a crossbeam or slat for a heddle frame of a loom, as well as a crossbeam obtained by this method, this crossbeam having at least one support section and one heddle-support rod or bar affixed to this section along a junction zone.

2. Discussion of Background Information

Heddle frames are well known in the textile industry and are mainly used in looms. Each heddle frame constitutes a rectangular structure arranged to hold the loom heddles. To this end, this rectangular structure conventionally has an upper crossbeam formed of a support section affixed to an upper heddle-support rod, a lower crossbeam formed of a support section affixed to a lower heddle-support rod, and two lateral posts assembled to the ends of the crossbeams to form the frame. The main function of support sections is to bring the rigidity that the heddle-support rods do not have, and these support sections include, as known, a cross-section that is larger than that of the heddle-support rods. Furthermore, in order to guarantee the correct functioning of the loom heddles and their sliding over the entire length of the frame, the heddle-support rods must necessarily be linear and parallel to each other with an accuracy of approximately + or −0.3 mm. It is noted that each loom heddle is constituted of a metal blade provided at its ends with a loop so that it can be mounted on the heddle-support rods, with an operational clearance, and with an eyelet in its center to hold and guide a warp thread. Therefore, there are as many loom heddles as there are warp threads, these loom heddles being distributed, for example, over two heddle frames. On the loom, the heddle frames are put in a reciprocal vertical movement by an adapted driving mechanism. For instance, for a speed of 1200 strokes per minute, each heddle frame is moved at a speed of 600 cycles per minute. The constant increase in weaving speeds has brought about new mechanical behaviors and technical difficulties for heddle frames as well as for loom heddles.

Currently, the support sections are essentially made of aluminum alloy, and the heddle-support rods are usually made of stainless steel and attached to the support sections by means of rivets in order to obtain a rigid assembly. The use of support sections made of aluminum alloy by extrusion or wiredrawing is an advantageous solution since it allows making, at reasonable cost, support sections having a reduced weight and a very good straightness. Also, the possible lack of straightness can be easily corrected by a mechanical straightening operation that is made possible due to the specific mechanical properties of the metal alloys. This straightness then allows using the aluminum support section as a reference for attaching the heddle-support rod thereto with rivets, making it straight. Indeed, this heddle-support rod is not necessarily itself linear, due to its low rigidity.

Nevertheless, this type of widely used heddle frame has modest performances in terms of rigidity, and low resistance to mechanical fatigue. These drawbacks are amplified with the increase in weaving speeds. In addition, the assembly of the heddle-support rods on the support sections by riveting generates concentrations of harmful stresses that can prematurely rupture the heddle frames due to substantial alternative dynamic stress.

An attempt has been made to overcome this drawback by incorporating stiffeners made of carbon fibers in the support sections, and by assembling the heddle-support rod by nesting in a groove provided on each support section, as described in Patent U.S. Pat. No. 4,913,194. However, this type of embodiment is complex and very expensive given the number and diversity of the parts to be assembled.

Another solution is to obtain support sections entirely made of composite materials, for example, by pultrusion of thermoset resins incorporating carbon fibers or glass fibers, and to attach the heddle-support rods by gluing. The composite materials have numerous advantages:

- in terms of lightness, they substantially reduce the mass and inertia of the frame, thus improving its dynamic behavior, and
- in terms of rigidity in traction and in compression, they increase its resistance to mechanical fatigue well beyond that of aluminum alloys.

Nonetheless, the performances in terms of straightness are relatively poor. For example, the average deflection of this type of section is approximately 1 mm per 1 meter of length. Knowing that in the field of heddle frames, the support sections can measure up to 4.2 meters, the possible deflection can reach approximately 4 mm. In addition, these composite materials allow no straightening, given that the resins are thermoset and therefore very rigid and irreversible. Using this type of support section implies a rigorous selection of support sections having an acceptable straightness in order to make a consistent heddle-support frame and, consequently, high costs given the substantial waste that it causes.

SUMMARY OF THE INVENTION

The object of the present invention is to overcome these drawbacks by proposing a method for manufacturing a crossbeam for a heddle frame for a loom, as well as a crossbeam obtained by this method, allowing to make, at low cost and without waste, a crossbeam combining properties of lightness and high rigidity, and whose heddle-support rod is positioned on the support section in an accurate position that is completely linear, this position being controlled and capable of being reproduced.

To this end, the invention relates to a manufacturing method of the type indicated in the preamble, characterized in that one uses a rigid template having at least one first straight groove having a width substantially equal to that of the heddle-support rod; the heddle-support rod is positioned in the groove to make it straight, a glue line is laid in the junction zone; the support section is positioned on the template and on the heddle-support rod in a predetermined manner and without stress by flattening the glue line; and the support section and heddle-support rod assembly is maintained affixed to the template at least while the glue is setting.

In a preferred manner, the template and the support section have complementary nesting shapes arranged to position the support section accurately with respect to the heddle-support rod.

In the case where the support section has a substantially rectangular cross-section, the template has a second groove, whose ends at least are straight and parallel to the first groove, this second groove being arranged to receive the substantially rectangular cross-section of the support section.

The support section can be non-straight, and the second groove of the template can have a width greater than the total width of the rectangular cross-section of the support section. In this case, one can use positioning members adapted to be mounted at the ends of the support section, these positioning members having a width substantially equal to that of the ends of the second groove.

In order to manufacture a number n of crossbeams, one advantageously uses a number n of templates, each template being superimposed on the previous one after the corresponding heddle-support rod, glue line and support section have been positioned, and one maintains the assembly of n support sections/n heddle-support rods affixed to the superimposed n templates, at least while the glue is setting.

To this end, the invention also relates to a crossbeam of the type indicated in the preamble, characterized in that the support section is rigid, in that the heddle-support rod is non-rigid, and in that the heddle-support rod is solidly attached by gluing to the support section in a straight position obtained by means of a template arranged to maintain the heddle-support rod with respect to the support section in this straight position, at least while the glue is setting.

The support section can be a non-straight section, made of composite materials and obtained by a method selected from the group that includes at least extrusion, pultrusion.

This support section can have a substantially rectangular cross-section that is extended by a straight section adapted to receive the heddle-support rod. It can also have a substantially rectangular cross-section in which a longitudinal groove adapted to receive the heddle-support rod is provided. This heddle-support rod can be metallic and can have a cross-section selected from the group that includes at least a T-shape, a J-shape.

The invention also provides for a method for manufacturing a crossbeam for a heddle frame of a loom, wherein the crossbeam comprises at least one support section and at least one heddle-support member affixed to the at least one support section along a junction zone, wherein the method comprises arranging the at least one heddle-support member within at least one groove of a rigid template, wherein the at least one groove has a width which is substantially equal to that of the at least one heddle-support member, applying a glue to a surface of the junction zone, positioning, in a predetermined manner, the at least one support section onto the rigid template and onto the at least one heddle-support member such that the glue is flattened, and ensuring that the at least one support section and the at least one heddle-support member are arranged on the rigid template at least while the glue is setting.

The glue comprises a line of glue. The at least one heddle-support member comprises at least one heddle-support rod. The glue is flattened in the junction zone. The surface of the junction zone comprises a surface of the at least one heddle-support member. The rigid template and the at least one support section comprise complementary nesting shapes, whereby the at least one support section is accurately positioned on the rigid template with respect to the at least one heddle-support member. The rigid template comprises another groove, wherein the other groove is structured and arranged to receive therein the at least one support section, whereby the at least one support section is accurately positioned on the rigid template with respect to the at least one heddle-support member. The at least one support section has at least a substantially rectangular cross-section. The at least one groove comprises at least one rectilinear groove.

The at least one groove comprises a first rectilinear groove and a second rectilinear groove, wherein, prior to the applying, the at least one heddle-support member is arranged within the first rectilinear groove and, after the applying, the at least one support section is arranged within the second rectilinear groove. The first and second rectilinear grooves are arranged parallel to one another. The at least one support section has at least a substantially rectangular cross-section which is received within the second rectilinear groove during the positioning.

The at least one support section is non-rectilinear, and wherein the rigid template comprises another groove having a width which is greater than a total width of a substantially rectangular cross-section of the at least one support section. The method may further comprise mounting positioning members to ends of the at least one support section, wherein the positioning members have a width which is substantially equal to ends of the other groove.

The method may further comprise superimposing at least one other rigid template on the rigid template, whereby a number of crossbeams are manufactured.

The method may further comprise arranging at least one other heddle-support member within at least one groove of another rigid template, wherein the at least one groove has a width which is substantially equal to that of the at least one other heddle-support member, applying a glue to a surface of the junction zone, positioning, in a predetermined manner, the at least one other support section onto the other rigid template and onto the at least one other heddle-support member such that the glue is flattened, and ensuring that the at least one other support section and the at least one other heddle-support member are arranged on the other rigid template at least while the glue is setting, wherein the other rigid template is superimposed on the rigid template so that a number of crossbeams are manufactured.

The invention also provides for a crossbeam for a heddle frame of a loom, wherein the crossbeam comprises at least one rigid support section, at least one non-rigid heddle-support member affixed to the at least one rigid support section along a junction zone, and a flattened glue line arranged within the junction zone, wherein the flattened glue line affixes the at least one non-rigid heddle-support member to the at least one rigid support section, and wherein the at least one non-rigid heddle-support member and the at least one rigid support section are affixed to each other via the flattened glue line while each of the at least one non-rigid heddle-support member and the at least one rigid support section are arranged on a rigid template having at least one groove whose width which is substantially equal to that of the at least one non-rigid heddle-support member.

The at least one rigid support section comprises at least one fiber composite rigid support section. The at least one rigid support section is a non-rectilinear section. The at least one rigid support section is made of composite materials. The at least one support section is made by extrusion. The at least one support section is made by pultrusion. The at least one rigid support section has a substantially rectangular cross-section portion and a substantially straight section which extends from the substantially rectangular cross-section portion, wherein the substantially straight section is affixed to the at least one non-rigid heddle-support member. The at least one rigid support section has a substantially rectangular cross-section portion which comprises a longitudinal groove which receives therein the at least one non-rigid heddle-support member. The at least one non-rigid heddle-support member is metallic. The at least one non-rigid heddle-support member has at least one of a T-shaped cross-section and a J-shaped cross-section.

The invention also provides for a crossbeam for a heddle frame of a loom, wherein the crossbeam comprises at least one rigid fiber composite support section, at least one non-rigid heddle-support member affixed to the at least one rigid support section along a junction zone, and a flattened glue line arranged within the junction zone, wherein the flattened glue line affixes the at least one non-rigid heddle-support member to the at least one rigid fiber composite support section, and wherein the at least one non-rigid heddle-support member and the at least one rigid support section are affixed to each other via the flattened glue line while each of the at least one non-rigid heddle-support member and the at least one rigid fiber composite support section are arranged on a rigid template having a first and second parallel grooves, wherein the first groove receives therein the at least one non-rigid heddle-support member and the second groove receives therein the at least one rigid fiber composite support section.

BRIEF DESCRIPTION OF THE DRAWINGS

The present invention is further described in the detailed description which follows, in reference to the noted plurality of drawings by way of nonlimiting examples of embodiments of the present invention, in which like reference numerals represent similar parts throughout the several views of the drawings, and wherein:

FIGS. 2A and 2B are side views of a crossbeam according to the invention, before and after assembly, respectively, FIGS. 5A and 5B are side views of an alternative embodiment of a crossbeam according to the invention before and after assembly, respectively.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

With reference to the Figures, the invention relates to a method for manufacturing a crossbeam 2, 2' for the heddle frame 1 of a loom, and a crossbeam 2, 2' obtained by this method.

Figure 1:
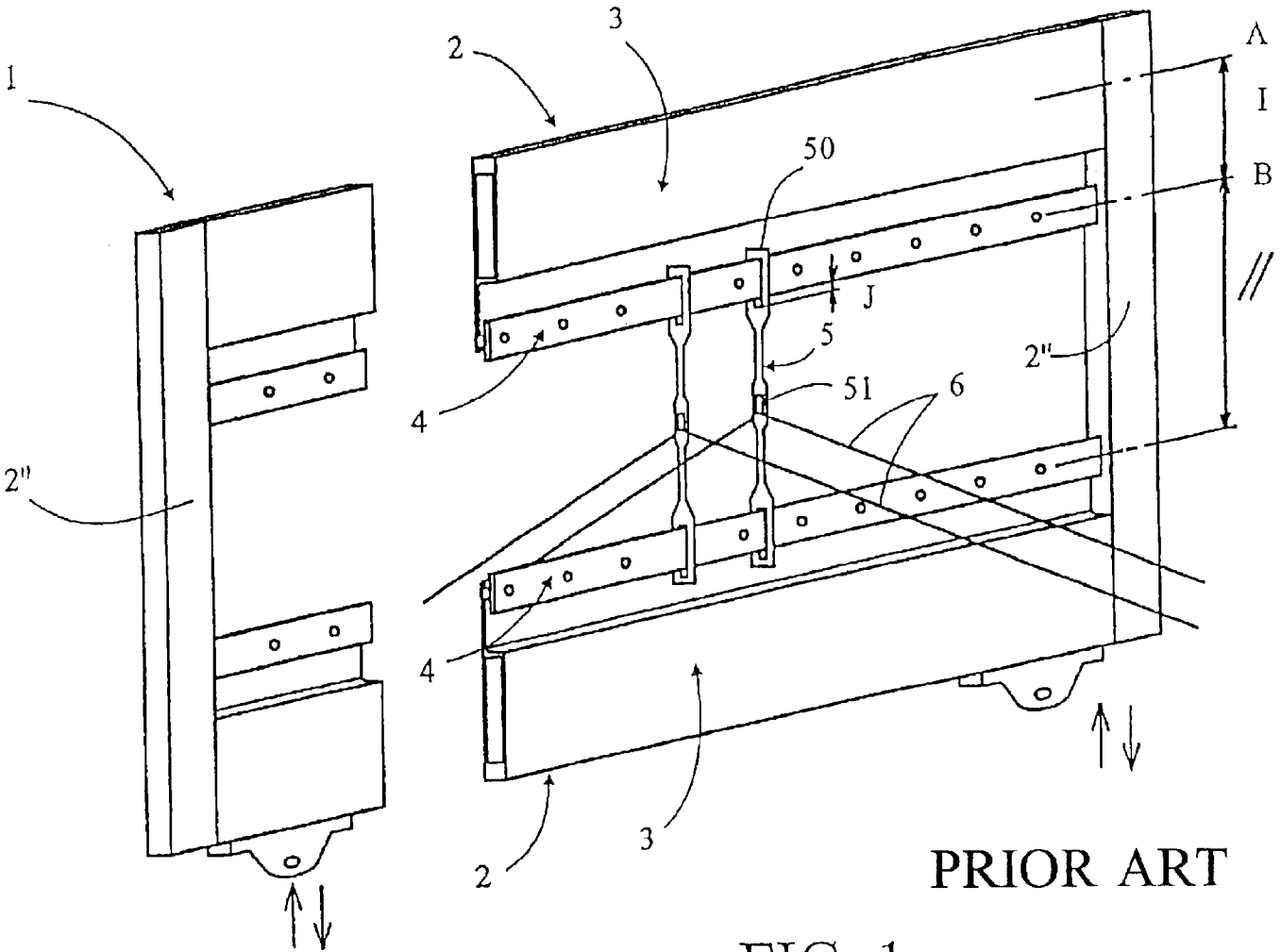
PRIOR ART FIG. 1
FIG. 1 is a perspective view of a conventional heddle frame for a loom.

An example of a conventional heddle frame 1 for a loom is shown in FIG. 1. As known, it has two substantially parallel crossbeams 2 that are assembled laterally by two posts 2". Each crossbeam 2 is formed of one support section 3 and one heddle-support rod 4. The heddle-support rods 4 have the function of holding and guiding a set of loom heddles 5, only two of which are shown, by their loop-shaped ends 50, while taking into account an operational clearance J. At the center, each loom heddle 5 has an eyelet 51 for the passage of a warp thread 6. These loom heddles 5 are generally made of a hardened metallic material, for example, stainless steel, in order to resist the mechanical stresses. In order to ensure this operational clearance J over the entire length of the heddle frame 1, the heddle-support rods 4 must be perfectly linear and parallel to each other by respecting an accuracy of approximately + or −0.3 mm.

With reference to FIGS. 2A and 2B, the support section 3 has a substantially rectangular cross-section 30 extended by a straight section 31 that is capable of receiving the heddle-support rod 4 along a junction zone 40 formed of a planar surface. This heddle-support rod 4 can have a horizontal T-shaped cross-section 4*a* or a J-shaped cross-section 4*b*, depending on the shape of the loops 50 of the loom heddles 5.

FIGS. 5A and 5B show an alternative embodiment of a crossbeam 2', in which the support section 3' has a substantially rectangular cross-section 30 in which a longitudinal groove 33 is provided that is capable of receiving the heddle-support rod 4' along a junction zone 40' formed of at least two planar parallel surfaces. The longitudinal groove 33 can be oriented parallel to the plane of the support section 3', according to the example shown, or perpendicularly according to the shape of the heddle-support rod 4'. This heddle-support rod 4' can have a cross-section in the shape of a horizontal T that is extended by a junction tab 4'*a*, a reverse J 4'*b*, or of an inverted T 4'*c*, depending on the shape of the loops 50 of the loom heddles 5.

In all of the cases, the substantially rectangular cross-section 30 of the support section 3, 3' has a central recess 32 that advantageously reduces its mass and material cost. This support section 3, 3' can have other cross-sections, for example, an I-shape.

With reference to FIGS. 3A–D, the method for manufacturing a crossbeam 2, 2' according to the invention includes at least the following steps:

1. A rigid template 7 is used having at least one first rectilinear groove 70 with a width substantially equal to that of the heddle-support rod 4, 4'.
2. The heddle-support rod 4, 4' is positioned in the groove 70 (see FIG. 3A).
3. A glue line is laid on the junction zone 40, 40', for example, by means of a nozzle 8 (see FIG. 3B).
4. The support section 3, 3' is positioned in a predetermined manner on the template 7 and on the heddle-support rod 4, 4' by flattening the glue line.
5. The support section 3, 3' and heddle-support rod 4, 4' assembly is maintained affixed to the template 7, at least while the glue is setting. This setting time can correspond to the polymerization time of the glue. Depending on the type of glue, one can lay the glue directly on the heddle-support rod 4, 4', and/or directly on the support section 3, 3'.

The model 7 and the support section 3, 3' have complementary nesting shapes that allow the accurate positioning of the support section 3, 3' with respect to the heddle-support rod 4, 4'. In the examples shown, the template 7 has a second groove 71 whose ends at least are rectilinear and parallel to the first groove 70. This second groove 71 has a width greater than the total width of the substantially rectangular cross-section 30 of the support section 3, 3'. In this example of embodiment, one uses positioning members 9 adapted to be mounted at the ends of the support section 3, 3', these positioning members having a width substantially equal to that of the ends of the second groove 71. In this example, the complementary nesting shapes are constituted of the positioning members 9 and the ends of the second groove 71. Naturally, one can provide other equivalent shapes.

Figure 3A:
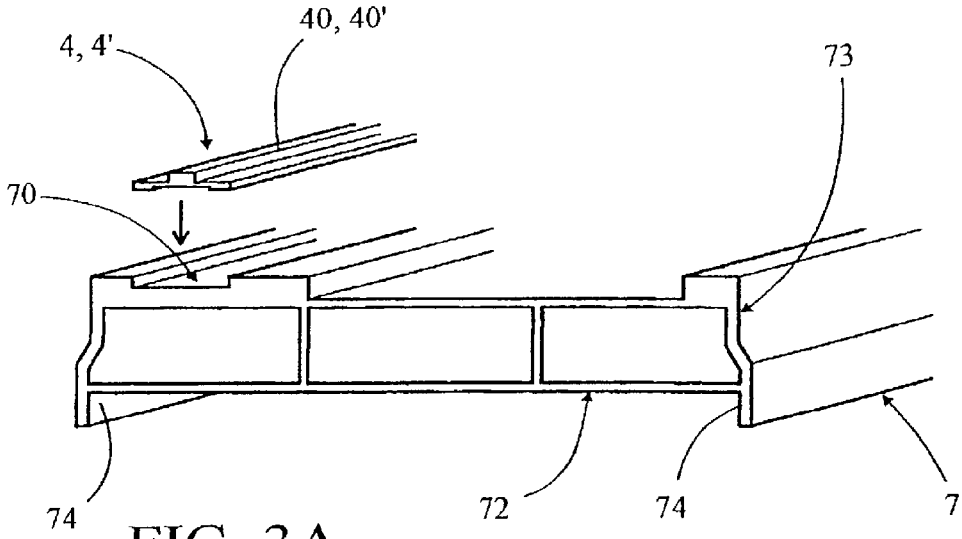
FIGS. 3A–D are partial perspective views of four steps of the manufacturing method according to the invention to make a crossbeam.
Figure 3C:
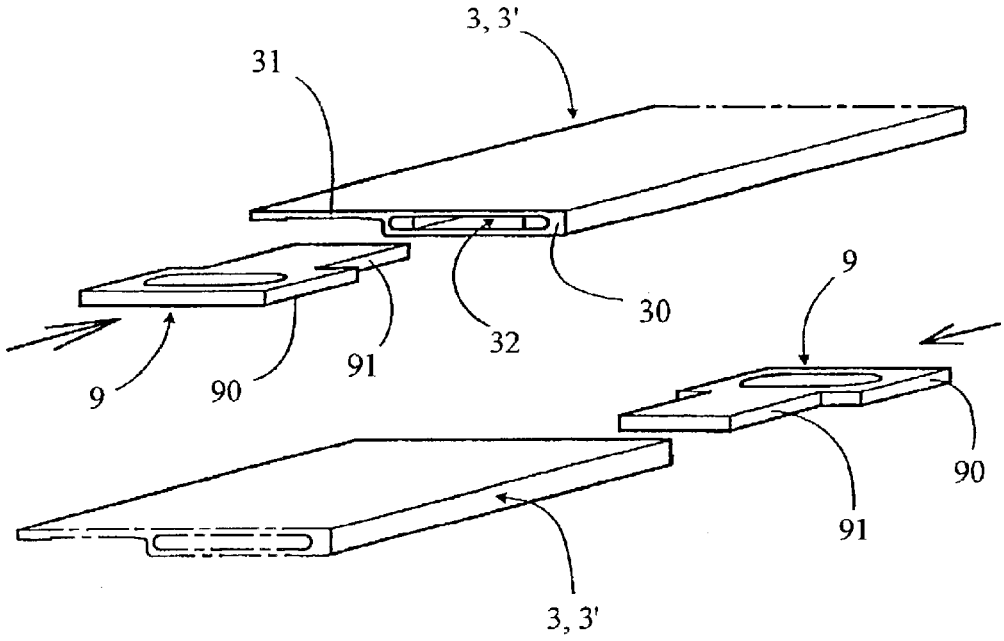
Figure 3B:
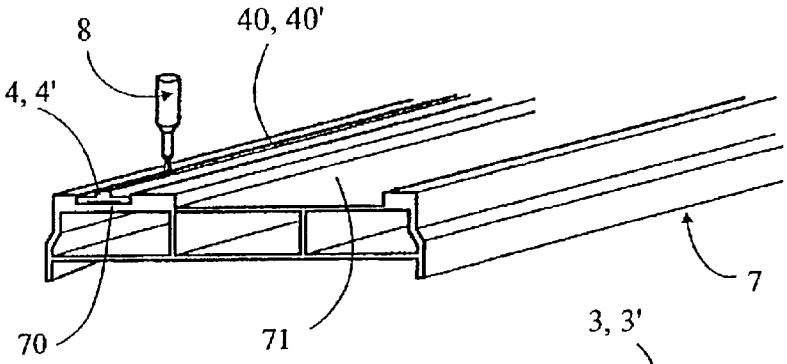
Figure 3D:
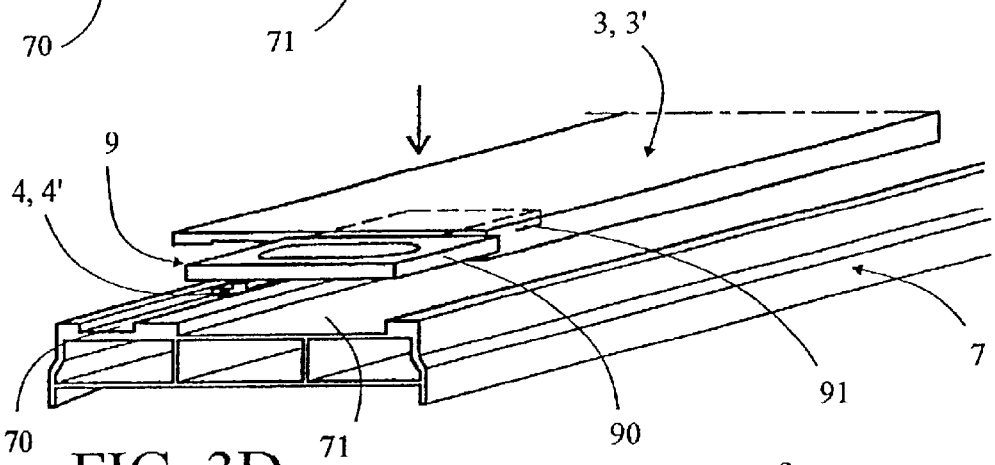

With reference to FIG. 3C, these positioning members 9 are constituted of a T-shaped plate 90, the stem of the T forming a male portion 91 capable of being nested in the central recess 32 of the support section 3, 3', and the bar of the T having a width equal to that of the ends of the groove 71 of the template 7. The manufacturing method then has a step in which the positioning members 9 are positioned in the ends of the support section 3, 3' (see FIG. 3C) before the support section 3, 3' is positioned in the template 7.

Using these positioning members 9, or any other equivalent means, allows ensuring an accurate positioning of the ends of the support section 3, 3' with respect to the heddle-support rod 4, 4', regardless of the straightness of the support section 3, 3'. Thus, the interval I between the axis A passing through the center of the central recess 32 at the ends of the support section 3, 3' and the central axis B of the heddle-support rod 4, 4' (see FIG. 1), is accurate and constant for all of the crossbeams 2, 2' manufactured according to this method, regardless of the straightness of the support section 3, 3'.

Figure 4:
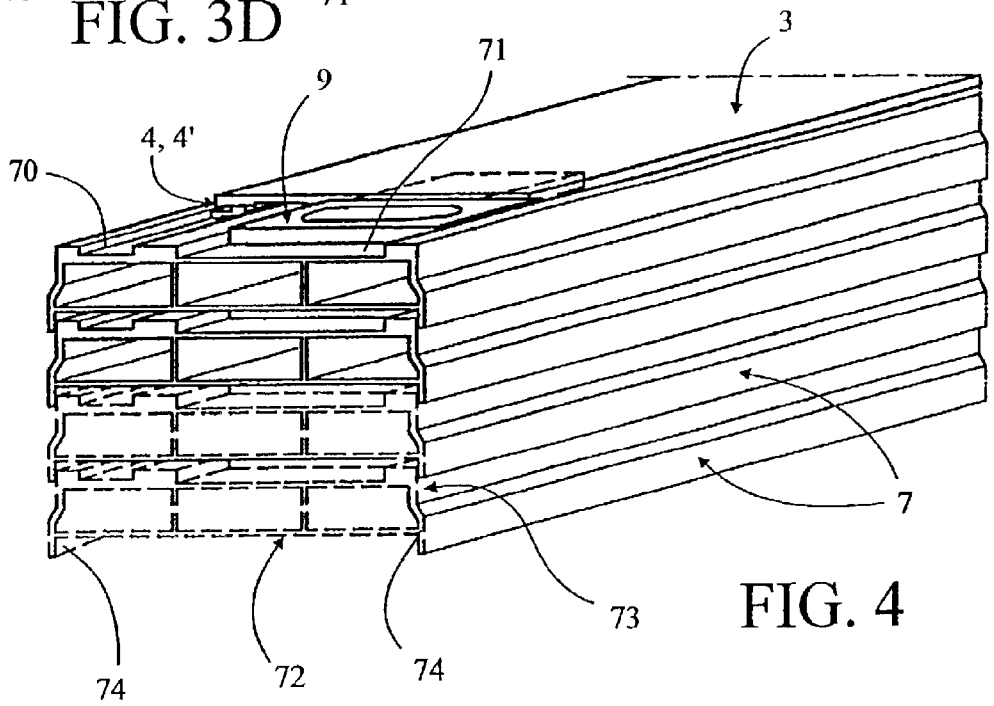
FIG. 4 is a partial perspective view of a step of the manufacturing method according to the invention to make a number n of crossbeams.

In order to manufacture a number n of crossbeams 2, 2', one can use a number n of identical templates 7 that are superimposed as shown in FIG. 4. In this case, the templates 7 have a rear portion that is wider than their front portion, forming a female nesting zone 72 and a male nesting zone 73, respectively. The rear zone has two longitudinal edges 74 demarcating the female nesting zone 72, the interval between these two longitudinal edges 74 corresponding to the width of the male nesting zone 73.

This manufacturing method therefore allows obtaining a crossbeam 2, 2' in which the heddle-support rod 4, 4' is solidly attached to the support section 3, 3' by gluing, in a rectilinear position obtained by means of the template 7 that is arranged to maintain this heddle-support rod 4, 4' in this position with respect to the support section 3, 3', at least while the glue is setting.

This manufacturing method is particularly advantageous when one uses a support section 3, 3' that is made of a rigid material but that does not necessarily have a rectilinear geometry, as well as a heddle-support rod 4, 4' that does not necessarily have a rectilinear geometry itself, but that is made of a non-rigid material allowing a straightening. This difference in rigidity is obtained from the selection of materials, but also from the differences in cross-section, the cross-section of the heddle-support rod 4, 4' being distinctly smaller than that of the support section 3, 3'. Before assembling the support section 3, 3' affixedly to the heddle-support rod 4, 4', this heddle-support rod 4, 4' that constitutes the functional portion of the crossbeam 2, 2' is set in a rectilinear position imparted by the template 7. The support section 3, 3' is then assembled to this heddle-support rod 4, 4' without being subject to a substantial deformation in the plane of this section. After assembly, during the removal of the crossbeam 2, 2' obtained from the template 7, the heddle-support rod 4, 4' remains in its rectilinear position given the substantial difference in rigidity between the support section 3, 3' and the heddle-support rod 4, 4'. Indeed, if the heddle-support rod 4, 4' tends to reassume its original shape, the support section 3, 3', being much more rigid, resists any deformation and sets the heddle-support rod 4, 4' in the position imparted by the template 7.

This manufacturing method is therefore particularly adapted to the support sections 3, 3' made of composite materials and obtained according to a continuous method, such as extrusion or pultrusion. These composite materials are, for example, thermoset resins based on carbon fibers, glass fibers or other fibers. They have the advantage of conferring to the support section 3, 3' a very high rigidity that increases its mechanical resistance to fatigue while substantially reducing its weight. The lack of straightness related to the use of these composite materials is no longer a drawback due to the combination of the template 7 and the positioning members 9, or any other equivalent means. However, this manufacturing method can also be advantageous for support sections 3, 3' made, in a conventional manner, of an aluminum alloy, in order to eliminate the preliminary step of straightening. In this case, gluing can be replaced by riveting, or any equivalent means.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method for manufacturing a crossbeam for a heddle frame of a loom, wherein the crossbeam comprises at least one support section and at least one heddle-support member affixed to the at least one support section along a junction zone, the method comprising:

arranging the at least one heddle-support member within at least one groove of a rigid template, wherein the at least one groove has a width which is substantially equal to that of the at least one heddle-support member;

applying a glue to a surface of the junction zone;

positioning, in a predetermined manner, the at least one support section onto the rigid template and onto the at least one heddle-support member such that the glue is flattened; and ensuring that the at least one support section and the at least one heddle-support member are arranged on the rigid template at least while the glue is setting.

2. The method of claim 1, wherein the glue comprises a line of glue.

3. The method of claim 1, wherein the at least one heddle-support member comprises at least one heddle-support rod.

4. The method of claim 1, wherein the glue is flattened in the junction zone.

5. The method of claim 1, wherein the surface of the junction zone comprises a surface of the at least one heddle-support member.

6. The method of claim 1, wherein the rigid template and the at least one support section comprise complementary nesting shapes, whereby the at least one support section is accurately positioned on the rigid template with respect to the at least one heddle-support member.

7. The method of claim 1, wherein the rigid template comprises another groove, wherein the other groove is structured and arranged to receive therein the at least one support section, whereby the at least one support section is accurately positioned on the rigid template with respect to the at least one heddle-support member.

8. The method of claim 1, wherein the at least one support section has at least a substantially rectangular cross-section.

9. The method of claim 1, wherein the at least one groove comprises at least one rectilinear groove.

10. The method of claim 1, wherein the at least one groove comprises a first rectilinear groove and a second rectilinear groove, wherein, prior to the applying, the at least one heddle-support member is arranged within the first rectilinear groove and, after the applying, the at least one support section is arranged within the second rectilinear groove.

11. The method of claim 10, wherein the first and second rectilinear grooves are arranged parallel to one another.

12. The method of claim 11, wherein the at least one support section has at least a substantially rectangular cross-section which is received within the second rectilinear groove during the positioning.

13. The method of claim 1, wherein the at least one support section is non-rectilinear, and wherein the rigid template comprises another groove having a width which is greater than a total width of a substantially rectangular cross-section of the at least one support section.

14. The method of claim 13, further comprising mounting positioning members to ends of the at least one support section, wherein the positioning members have a width which is substantially equal to ends of the other groove.

15. The method of claim 1, further comprising superimposing at least one other rigid template on the rigid template, whereby a number of crossbeams are manufactured.

16. The method of claim 1, further comprising:

arranging at least one other heddle-support member within at least one groove of another rigid template, wherein the at least one groove has a width which is substantially equal to that of the at least one other heddle-support member;

applying a glue to a surface of the junction zone;

positioning, in a predetermined manner, the at least one other support section onto the other rigid template and onto the at least one other heddle-support member such that the glue is flattened; and ensuring that the at least one other support section and the at least one other heddle-support member are arranged on the other rigid template at least while the glue is setting, wherein the other rigid template is superimposed on the rigid template so that a number of crossbeams are manufactured.

17. A crossbeam for a heddle frame of a loom, the crossbeam comprising:

at least one rigid support section;

at least one non-rigid heddle-support member affixed to the at least one rigid support section along a junction zone; and a flattened glue line arranged within the junction zone;

wherein the flattened glue line affixes the at least one non-rigid heddle-support member to the at least one rigid support section; and wherein the at least one non-rigid heddle-support member and the at least one rigid support section are affixed to each other via the flattened glue line while each of the at least one non-rigid heddle-support member and the at least one rigid support section are arranged on a rigid template having at least one groove whose width which is substantially equal to that of the at least one non-rigid heddle-support member.

18. The crossbeam of claim 17, wherein at least one rigid support section comprises at least one fiber composite rigid support section.

19. The crossbeam of claim 17, wherein the at least one rigid support section is a non-rectilinear section.

20. The crossbeam of claim 17, wherein the at least one rigid support section is made of composite materials.

21. The crossbeam of claim 17, wherein the at least one support section is made by extrusion.

22. The crossbeam of claim 17, wherein the at least one support section is made by pultrusion.

23. The crossbeam of claim 17, wherein the at least one rigid support section has a substantially rectangular cross-section portion and a substantially straight section which extends from the substantially rectangular cross-section portion, wherein the substantially straight section is affixed to the at least one non-rigid heddle-support member.

24. The crossbeam of claim 17, wherein the at least one rigid support section has a substantially rectangular cross-section portion which comprises a longitudinal groove which receives therein the at least one non-rigid heddle-support member.

25. The crossbeam of claim 17, wherein the at least one non-rigid heddle-support member is metallic.

26. The crossbeam of claim 17, wherein the at least one non-rigid heddle-support member has at least one of a T-shaped cross-section and a J-shaped cross-section.

27. A crossbeam for a heddle frame of a loom, the crossbeam comprising:

at least one rigid fiber composite support section;

at least one non-rigid heddle-support member affixed to the at least one rigid support section along a junction zone; and a flattened glue line arranged within the junction zone;

wherein the flattened glue line affixes the at least one non-rigid heddle-support member to the at least one rigid fiber composite support section; and wherein the at least one non-rigid heddle-support member and the at least one rigid support section are affixed to each other via the flattened glue line while each of the at least one non-rigid heddle-support member and the at least one rigid fiber composite support section are arranged on a rigid template having a first and second parallel grooves, wherein the first groove received therein the at least one non-rigid heddle-support member and the second groove receives therein the at least one rigid fiber composite support section.

* * * * *